US009063480B2

(12) United States Patent
Yoshiura et al.

(10) Patent No.: US 9,063,480 B2
(45) Date of Patent: Jun. 23, 2015

(54) FIXING DEVICE, IMAGE FORMING DEVICE, AND SEPARATING MEMBER

(71) Applicants: Arinobu Yoshiura, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Hajime Gotoh, Kanagawa (JP); Akira Suzuki, Tokyo (JP); Hiroshi Yoshinaga, Chiba (JP)

(72) Inventors: Arinobu Yoshiura, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takuya Seshita, Kanagawa (JP); Takeshi Uchitani, Kanagawa (JP); Hajime Gotoh, Kanagawa (JP); Akira Suzuki, Tokyo (JP); Hiroshi Yoshinaga, Chiba (JP)

(73) Assignee: Ricoh Company, Limited, Tokyo (JP)

( * ) Notice: Subject to any disclaimer, the term of this patent is extended or adjusted under 35 U.S.C. 154(b) by 119 days.

(21) Appl. No.: 13/728,304

(22) Filed: Dec. 27, 2012

(65) Prior Publication Data

US 2013/0170877 A1 Jul. 4, 2013

(30) Foreign Application Priority Data

Dec. 28, 2011 (JP) ..... 2011-288988
Feb. 9, 2012 (JP) ..... 2012-026217
Oct. 22, 2012 (JP) ..... 2012-232949

(51) Int. Cl.
*G03G 15/20* (2006.01)

(52) U.S. Cl.
CPC ..... *G03G 15/2028* (2013.01); *G03G 15/2085* (2013.01); *G03G 2215/2035* (2013.01)

(58) Field of Classification Search
CPC ..... G03G 15/2028
USPC ..... 399/323, 328, 329
See application file for complete search history.

(56) References Cited

U.S. PATENT DOCUMENTS 7,885,590 B2 2/2011 Seo et al.
2004/0184848 A1 9/2004 Oonishi (Continued)

FOREIGN PATENT DOCUMENTS

JP 2861280 12/1998
JP 2002-268438 A 9/2002

(Continued)

OTHER PUBLICATIONS

U.S. Appl. No. 13/557,841, filed Jul. 25, 2012, Toshihiko Shimokawa, et al.

(Continued)

*Primary Examiner* — Hoang Ngo
(74) *Attorney, Agent, or Firm* — Harness, Dickey & Pierce

(57) ABSTRACT

In an embodiment, provided is a fixing device that includes: a fixing belt rotatable and endless; a belt holding member holding the fixing belt at each end part in an axial direction; a heat source heating the fixing belt; a nip forming member provided inside the fixing belt; an opposing rotator forming a nip portion between the opposing rotator and the fixing belt via the fixing belt; and a separating member that extends near the nip portion and separates a recording medium from a surface of the fixing belt. A leading end of the separating member is provided with a receding portion and an approaching portion that is at a different position from a position of the receding portion different in the axial direction. The approaching portion is provided nearer to the nip portion than the receding portion is provided.

18 Claims, 10 Drawing Sheets

(56) References Cited

U.S. PATENT DOCUMENTS

| | | | |
|---|---|---|---|
| 2006/0029411 | A1 | 2/2006 | Ishii et al. |
| 2007/0189818 | A1 | 8/2007 | Kondo et al. |
| 2007/0212089 | A1 | 9/2007 | Seo et al. |
| 2007/0280754 | A1 | 12/2007 | Ogawa et al. |
| 2007/0292175 | A1 | 12/2007 | Shinshi |
| 2008/0025772 | A1 | 1/2008 | Seo et al. |
| 2008/0025773 | A1 | 1/2008 | Ito et al. |
| 2008/0175633 | A1 | 7/2008 | Shinshi |
| 2008/0219721 | A1 | 9/2008 | Ito et al. |
| 2008/0219730 | A1 | 9/2008 | Shinshi |
| 2008/0226326 | A1 | 9/2008 | Seo et al. |
| 2008/0232873 | A1 | 9/2008 | Ueno et al. |
| 2009/0123201 | A1 | 5/2009 | Ehara et al. |
| 2009/0148205 | A1 | 6/2009 | Seo et al. |
| 2009/0245865 | A1 | 10/2009 | Shinshi et al. |
| 2009/0245897 | A1 | 10/2009 | Seo et al. |
| 2009/0274492 | A1 | 11/2009 | Ishikawa |
| 2009/0297197 | A1 | 12/2009 | Hase |
| 2010/0061753 | A1 | 3/2010 | Hase |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2010/0303521 | A1 | 12/2010 | Ogawa et al. |
| 2010/0303523 | A1* | 12/2010 | Yamada ..... 399/323 |
| 2011/0026988 | A1 | 2/2011 | Yoshikawa et al. |
| 2011/0044706 | A1 | 2/2011 | Iwaya et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052277 | A1 | 3/2011 | Ueno et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064450 | A1 | 3/2011 | Ishii et al. |
| 2011/0064490 | A1 | 3/2011 | Imada et al. |
| 2011/0064502 | A1 | 3/2011 | Hase et al. |
| 2011/0070003 | A1 | 3/2011 | Shinshi |
| 2011/0076071 | A1 | 3/2011 | Yamaguchi et al. |
| 2011/0085815 | A1 | 4/2011 | Kishi et al. |
| 2011/0085832 | A1 | 4/2011 | Hasegawa et al. |
| 2011/0091253 | A1 | 4/2011 | Seo et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0170917 | A1 | 7/2011 | Yoshikawa et al. |
| 2011/0176821 | A1 | 7/2011 | Hase |
| 2011/0176822 | A1 | 7/2011 | Ishii et al. |
| 2011/0182634 | A1 | 7/2011 | Ishigaya et al. |
| 2011/0182638 | A1 | 7/2011 | Ishii et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222876 | A1 | 9/2011 | Yuasa et al. |
| 2011/0222888 | A1 | 9/2011 | Ikebuchi et al. |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0229162 | A1 | 9/2011 | Ogawa et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0229236 | A1 | 9/2011 | Ehara et al. |
| 2011/0274453 | A1 | 11/2011 | Shimokawa et al. |
| 2011/0286758 | A1 | 11/2011 | Yoshinaga |
| 2011/0293309 | A1 | 12/2011 | Hase |
| 2011/0311284 | A1 | 12/2011 | Seo et al. |
| 2012/0045226 | A1 | 2/2012 | Hase et al. |
| 2012/0051766 | A1 | 3/2012 | Ueno et al. |
| 2012/0051774 | A1 | 3/2012 | Ikebuchi et al. |
| 2012/0093531 | A1 | 4/2012 | Yuasa et al. |
| 2012/0093551 | A1 | 4/2012 | Ogawa et al. |
| 2012/0107005 | A1 | 5/2012 | Hase et al. |
| 2012/0114345 | A1 | 5/2012 | Fujimoto et al. |
| 2012/0114354 | A1 | 5/2012 | Saito et al. |
| 2012/0121303 | A1 | 5/2012 | Takagi et al. |
| 2012/0121304 | A1 | 5/2012 | Tokuda et al. |
| 2012/0121305 | A1 | 5/2012 | Yoshikawa et al. |
| 2012/0148303 | A1 | 6/2012 | Yamaguchi et al. |
| 2012/0155935 | A1 | 6/2012 | Yoshikawa et al. |
| 2012/0155936 | A1 | 6/2012 | Yamaguchi et al. |
| 2012/0177388 | A1 | 7/2012 | Imada et al. |
| 2012/0177393 | A1 | 7/2012 | Ikebuchi et al. |
| 2012/0177420 | A1 | 7/2012 | Shimokawa et al. |
| 2012/0177423 | A1 | 7/2012 | Imada et al. |
| 2012/0177424 | A1 | 7/2012 | Saito et al. |
| 2012/0207523 | A1 | 8/2012 | Ueno et al. |
| 2012/0219312 | A1 | 8/2012 | Yuasa et al. |
| 2012/0224878 | A1 | 9/2012 | Ikebuchi et al. |
| 2012/0237273 | A1 | 9/2012 | Yoshinaga et al. |

FOREIGN PATENT DOCUMENTS

| | | |
|---|---|---|
| JP | 2004-053618 | 2/2004 |
| JP | 2004-286922 | 10/2004 |
| JP | 2005-049647 | 2/2005 |
| JP | 2005-257968 | 9/2005 |
| JP | 2007-233011 | 9/2007 |
| JP | 2007-334205 | 12/2007 |
| JP | 2008-158482 | 7/2008 |
| JP | 2008-216928 | 9/2008 |
| JP | 2009-271115 | 11/2009 |
| JP | 2010-078747 | 4/2010 |
| JP | 2010-091595 | 4/2010 |
| JP | 2011-059387 | 3/2011 |
| JP | 4742165 | 5/2011 |
| JP | 2011-186307 | 9/2011 |
| JP | 2011-186397 | 9/2011 |

OTHER PUBLICATIONS

Office Action for corresponding Chinese Application No. 2012-10599348.8 dated Jan. 6, 2015 and English Translation.

* cited by examiner

FIXING DEVICE, IMAGE FORMING DEVICE, AND SEPARATING MEMBER

CROSS-REFERENCE TO RELATED APPLICATIONS

The present application claims priority to and incorporates by reference the entire contents of Japanese Patent Application No. 2011-288988 filed in Japan on Dec. 28, 2011, Japanese Patent Application No. 2012-026217 filed in Japan on Feb. 9, 2012, and Japanese Patent Application No. 2012-232949 filed in Japan on Oct. 22, 2012.

BACKGROUND OF THE INVENTION

1. Field of the Invention

The present invention relates to a fixing device including a separating member for separating a recording medium from a fixing rotator, an image forming device including the fixing device, and the separating member.

2. Description of the Related Art

In recent years, the market has more strongly required speed increase and energy saving for image forming devices such as printers, copiers, and facsimiles. Through an image forming process such as electronic photograph recording, electrostatic recording, and magnetic recording, an image forming device forms an unfixed toner image on a recording medium such as a recording medium sheet, a sheet of print paper, a sheet of photosensitive paper, or a sheet of electrostatic recording paper by an image transfer method or a direct method. For fixing the unfixed toner image, the fixing device often employs a contact heating method such as a thermal roller method, a film heating method, or an electromagnetic induction heating method.

As an example of such a fixing device, a belt type fixing device (see Japanese Patent Application Laid-open No. 2004-286922, for example) and a fixing device of SURF fixing (film fixing) using a ceramic heater (see Japanese Patent No. 2861280, for example) are known.

The belt type fixing device has been recently desired to have a shorter warm-up time (time required for a normal-temperature condition to reach a predetermined printable temperature (reload temperature) at a power-on time, for example) or a shorter first-printing time (time required for completing the discharge of paper after reception of a print request, preparation for printing, and printing operation) (Object 1). Along with the speed increase of the image forming device, the number of feeding sheets per unit time has increased and a larger quantity of heat has been required, resulting in a problem of shortage of the quantity of heat especially at the beginning of successive printing, which is called temperature drop (Object 2).

Meanwhile, the SURF fixing type using a ceramic heater, the heat capacity and the size thereof can be reduced as compared with the belt type fixing device; therefore, Object 1 can be solved. However, since just a nip portion of the SURF fixing type is locally heated, the other parts are not heated; the belt is the coolest at the entrance of a nip sheet or the like, which causes a problem in that fixing failure easily occurs. In particular, a high-speed machine is more likely to face a problem of higher probability of fixing failure because the belt rotation is fast and the heat release of the belt at other than the nip portion is increased (Object 3).

For solving Objects 1 to 3 as above, a fixing device has been suggested that can provide excellent fixing property even when the device is mounted on a highly productive image forming device including an endless belt (see Japanese Patent Application Laid-open No. 2007-334205).

This fixing device includes an endless belt 100, a metal thermal conductor 200 with a pipe shape installed inside the endless belt 100, a heat source 300 installed inside the metal thermal conductor 200, and a pressing roller 400 forming a nip portion N by abutting on the metal thermal conductor 200 via the endless belt 100, as depicted in FIG. 13. The rotation of the pressing roller 400 causes the endless belt 100 to rotate together, at which time the metal thermal conductor 200 guides the movement of the endless belt 100. The heat source 300 inside the metal thermal conductor 200 heats the endless belt 100 via the metal thermal conductor 200, thereby allowing the entire endless belt 100 to be heated. Thus, the first printing time from the heating stand-by time can be shortened, and the shortage of the quantity of heat at the high-speed rotation can be solved.

However, for further saving energy and improving the first printing time, the thermal efficiency needs to be improved further. In view of this, a configuration has been suggested in which the endless belt is directly (not via the metal thermal conductor) heated instead of indirectly heating the endless belt via the metal thermal conductor (see Japanese Patent Application Laid-open No. 2007-233011).

In this configuration, as depicted in FIG. 14, the pipe-shaped metal thermal conductor is removed from the inside of the endless belt 100 and a plate-shaped nip forming member 500 is formed instead at a position facing the pressing roller 400. In the case of this configuration, the endless belt 100 can be directly heated by the heat source 300 at a place other than the part provided with the nip forming member 500; thus, the heat conduction efficiency is drastically improved and the power consumption is reduced. As a result, the first printing time from the heating stand-by time can be further shortened. Moreover, the cost reduction can be achieved by omission of the metal thermal conductor.

As illustrated in FIG. 14, in the case of employing the configuration in which the endless belt is directly heated, no members exist that hold the fixing belt along the entire length (for example, the metal thermal conductor 200 depicted in FIG. 13); therefore, a problem is caused in that the radial cross-sectional shape of the fixing belt gets instable and varies in an axial direction. In this case, the gap between the fixing belt and a separating member for separating the sheet of paper having passed through the fixing nip from the fixing belt becomes inhomogeneous in the axial direction. This might lead to clogging of paper (jam) due to separation failure or a damage of the fixing belt due to the contact with the separating member, for example.

In view of this, there is a need to provide a fixing device in which the separation gap between the separating member and the fixing belt are substantially homogenized.

SUMMARY OF THE INVENTION

It is an object of the present invention to at least partially solve the problems in the conventional technology.

In an embodiment, provided is a fixing device that includes: a fixing belt that is rotatable and endless; a belt holding member holding the fixing belt at each end part in an axial direction thereof; a heat source heating the fixing belt; a nip forming member provided inside the fixing belt; an opposing rotator forming a nip portion between the opposing rotator and the fixing belt by abutting onto the nip forming member via the fixing belt; and a separating member that extends near the nip portion and separates a recording medium from a surface of the fixing belt. A leading end of the separating member is provided with a receding portion and an approaching portion that is at a different position in the axial direction from a position of the receding portion. The approaching portion is provided nearer to the nip portion along the extending direction of the separating member than the receding portion is provided.

In another embodiment, provided is an image forming device that includes a fixing device. The fixing device includes: a fixing belt that is rotatable and endless; a belt holding member holding the fixing belt at each end part in an axial direction thereof; a heat source heating the fixing belt; a nip forming member provided inside the fixing belt; an opposing rotator forming a nip portion between the opposing rotator and the fixing belt by abutting onto the nip forming member via the fixing belt; and a separating member that extends near the nip portion and separates a recording medium from a surface of the fixing belt. A leading end of the separating member is provided with a receding portion and an approaching portion that is at a different position in the axial direction from a position of the receding portion. The approaching portion is provided nearer to the nip portion along the extending direction of the separating member than the receding portion is provided.

In still another embodiment, provided is a separating member having a leading end that is configured to be provided close to a rotatable endless fixing belt of which both end parts in an axial direction are held by a belt holding member, and is configured to separate a recording medium from a surface of the fixing belt. The leading end has various thicknesses in the axial direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
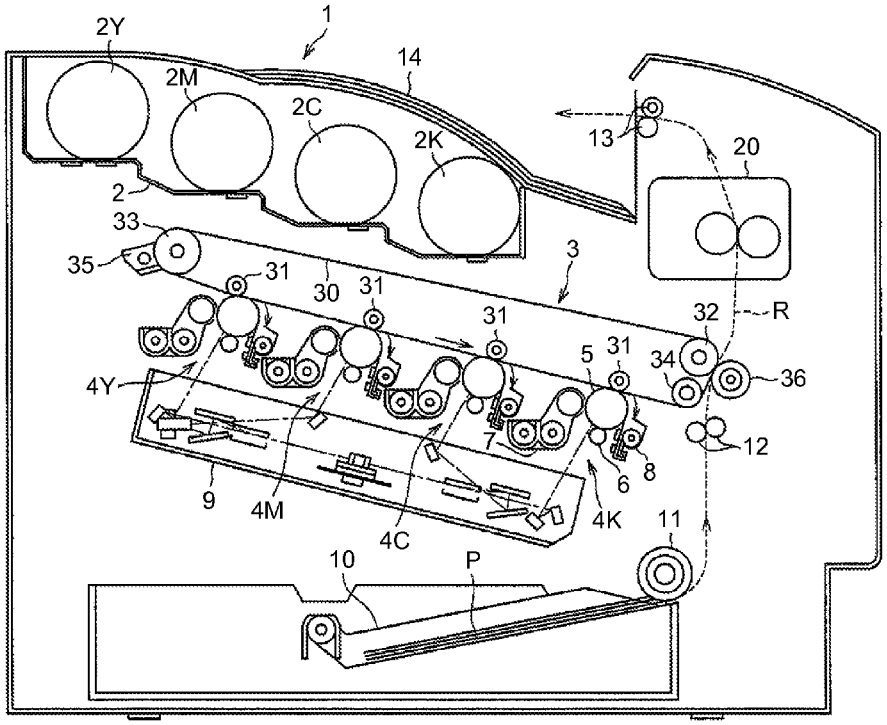
FIG. 1 is a sectional view illustrating a schematic configuration of an image forming device according to an embodiment.

Embodiments are hereinafter described based on attached drawings. Note that in the drawings used in the description of the embodiments, members or structure components in configurations having the same function or the same shape are denoted with the same reference symbols as long as discrimination is possible, so that the description thereof is not repeated.

First Embodiment

First, the entire configuration and operation of an image forming device according to an embodiment are described with reference to FIG. 1. An image forming device 1 depicted in FIG. 1 is a color laser printer, and four image forming units 4Y, 4M, 4C, and 4K are provided in a center of the device body. The image forming units 4Y, 4M, 4C, and 4K have similar configurations except that they contain developers with different colors of yellow (Y), magenta (M), cyan (C), and black (K) corresponding to color separation components of a color image, respectively.

Specifically, each of the image forming units 4Y, 4M, 4C, and 4K includes a drum-shaped photosensitive element 5 as a latent image carrier, a charging device 6 for charging a surface of the photosensitive element 5, a developing unit 7 for supplying a toner to the surface of the photosensitive element 5, and a cleaning device 8 for cleaning the surface of the photosensitive element 5, for example. Note that in FIG. 1, only the photosensitive element 5, the charging device 6, the developing unit 7, and the cleaning device 8 in the black image forming unit 4K are denoted with the reference symbols; the reference symbols in the other image forming units 4Y, 4M, and 4C are omitted.

An exposing device 9 for light-exposing the surface of the photosensitive element 5 is disposed below the image forming units 4Y, 4M, 4C, and 4K. The exposing device 9 includes a light source, a polygonal mirror, an f-θ lens, a reflection mirror, and the like, and delivers laser light to the surface of each photosensitive element 5 based on the image data.

A transfer device 3 is installed above the image forming units 4Y, 4M, 4C, and 4K. The transfer device 3 includes an intermediate transfer belt 30 as a transfer body, four primary transfer rollers 31 as primary transfer units, a secondary transfer roller 36 as a secondary transfer unit, a secondary transfer backup roller 32, a cleaning backup roller 33, a tension roller 34, and a belt cleaning device 35.

The intermediate transfer belt 30 is an endless belt, and is extended by the secondary transfer backup roller 32, the cleaning backup roller 33, and the tension roller 34. Here, the rotation driving of the secondary transfer backup roller 32 causes the intermediate transfer belt 30 to run around (rotate) in a direction indicated by an arrow in the figure.

Each of the four primary transfer rollers 31 forms a primary transfer nip with the intermediate transfer belt 30 held between the primary transfer roller 31 and the photosensitive element 5. Each primary transfer roller 31 is connected to a power supply, which is not illustrated, so that predetermined direct voltage (DC) and/or alternating current (AC) is applied to each primary transfer roller 31.

The secondary transfer roller 36 forms a secondary transfer nip with the intermediate transfer belt 30 held between the secondary transfer roller 36 and the secondary transfer backup roller 32. In a manner similar to the primary transfer roller 31, the secondary transfer roller 36 is also connected to a power supply, which is not illustrated, so that predetermined direct voltage (DC) and/or alternating current (AC) is applied to the secondary transfer roller 36.

The belt cleaning device 35 includes a cleaning brush and a cleaning blade provided to abut on the intermediate transfer belt 30. A waste toner transporting hose, which is not illustrated, extending from the belt cleaning device 35 is connected to the entrance of a waste toner container, which is not illustrated.

An upper part of the printer body is provided with a bottle container 2. To the bottle container 2, four toner bottles 2Y, 2M, 2C, and 2K containing supplementary toners are detachably mounted. A supply path, which is not illustrated, is provided between each of the toner bottles 2Y, 2M, 2C, and 2K and each developing unit 7. Through this supply path, the toner is supplied from each of the toner bottles 2Y, 2M, 2C, and 2K to the developing unit 7.

Meanwhile, a lower part of the printer body is provided with a paper cassette 10 housing sheets of paper Pas a recording medium, a paper feed roller 11 for carrying the paper P out of the paper cassette 10, and the like. The recording medium includes, other than plain paper, thick paper, postcards, envelopes, coated paper (including coat paper and art paper), tracing paper, OHP sheets, and the like. Although not illustrated, a bypass feeding system may be provided.

Inside the printer body is provided a feed path R for discharging the paper P out of the device through the secondary transfer nip from the paper cassette 10. In the feed path R, a pair of registration rollers 12 as a conveying unit for conveying the paper P to the secondary transfer nip is provided on the upstream side of the secondary transfer roller 36 in the paper conveying direction.

A fixing device 20 for fixing an unfixed image transferred to the paper P is provided on the downstream side of the secondary transfer roller 36 in the paper conveying direction. Further, a pair of discharging rollers 13 for discharging the sheet out of the device is provided on the downstream side of the fixing device 20 in the paper conveying direction of the feed path R. A discharge tray 14 for storing the paper discharged out of the device is provided on an upper surface part of the printer body.

Next, a basic operation of the printer according to the embodiment is described with reference to FIG. 1. Upon the start of the image forming operation, each photosensitive element 5 of the image forming units 4Y, 4M, 4C, and 4K is rotated and driven clockwise in the drawing by a driving device, which is not illustrated, and the surface of each photosensitive element 5 is uniformly charged by the charging device 6 to have predetermined polarity. The charged surface of each photosensitive element 5 is irradiated with laser light from the exposing device 9, thereby forming an electrostatic latent image on the surface of each photosensitive element 5. On this occasion, the image information formed on each photosensitive element 5 by the light exposure is single-color image information obtained by separating a desired full-color image into color information of yellow, magenta, cyan, and black. The electrostatic latent image formed on each photosensitive element 5 is visualized (made visible) as a toner image by supply of toner by each developing unit 7.

After the start of the image forming operation, the secondary transfer backup roller 32 is rotated and driven counterclockwise in the drawing to make the intermediate transfer belt 30 run around in a direction indicated by an arrow in the drawing. Then, voltage which is controlled at constant voltage or constant current and whose polarity is opposite of the polarity of the charged toner is applied to each primary transfer roller 31. Thus, the transfer electric field is formed in the primary transfer nip between each primary transfer roller 31 and each photosensitive element 5.

After that, when the toner image of each color on the photosensitive element 5 has reached the primary transfer nip along with the rotation of each photosensitive element 5, the toner images on the photosensitive elements 5 are sequentially overlapped on the intermediate transfer belt 30 by the transfer electric field formed on the primary transfer nip. In this manner, the full-color toner image is carried on the surface of the intermediate transfer belt 30. The toner remaining on each photosensitive element 5 after the completion of the transfer to the intermediate transfer belt 30 is removed by the cleaning device 8. After that, the electricity of the surface of each photosensitive element 5 is eliminated by a neutralization device, which is not illustrated, so that the surface potential is initialized.

In the lower part of the image forming device, the paper feed roller 11 starts to rotate and drive, thereby feeding the paper P from the paper cassette 10 to the feed path R. The paper P sent to the feed path R is fed to the secondary transfer nip between the secondary transfer roller 36 and the secondary transfer backup roller 32 in accordance with the timing determined by the registration roller 12. On this occasion, the transfer voltage with the opposite polarity to the toner charged polarity of the toner image on the intermediate transfer belt 30 is applied to the secondary transfer roller 36, so that the transfer electric field is formed on the secondary transfer nip.

After that, when the toner image on the intermediate transfer belt 30 has reached the secondary transfer nip along with the running of the intermediate transfer belt 30, the toner images on the intermediate transfer belt 30 are collectively transferred onto the paper P by the transfer electric field formed on the secondary transfer nip. Moreover, the toner remaining on the intermediate transfer belt 30 that cannot be transferred to the paper P is removed by the belt cleaning device 35 and the removed toner is transported to and collected in the waste toner container, which is not illustrated.

After that, the paper P is conveyed to the fixing device 20 by which the toner image on the paper P is fixed on the paper P. Then, the paper P is discharged out of the device by the discharging rollers 13 and stored on the discharge tray 14.

The above description applies to the image forming operation for forming a full-color image on the paper; alternatively, a monochromatic image can be formed using any one of the four image forming units 4Y, 4M, 4C, and 4K or a two-color or three-color image can be also formed by using two or three image forming units.

Figure 2:
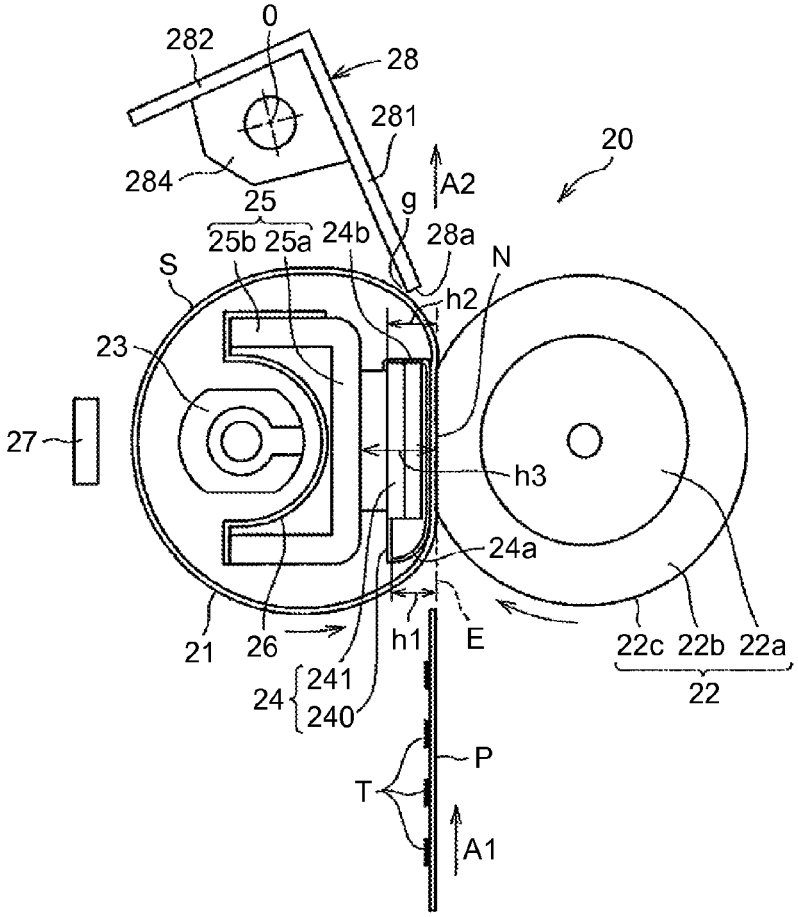
FIG. 2 is a sectional view illustrating a schematic configuration of a fixing device mounted on the image forming device.

Next, the configuration of the fixing device 20 is described with reference to FIG. 2. As depicted in FIG. 2, the fixing device 20 includes: a fixing belt 21 as a rotatable fixing rotator; a pressing roller 22 as a counter rotator provided rotatably to face the fixing belt 21; a halogen heater 23 as a heat source for heating the fixing belt 21; a nip forming member 24 disposed inside the fixing belt 21; a stay 25 as a support member for supporting the nip forming member 24; a reflecting member 26 for reflecting the light emitted from the halogen heater 23 to the fixing belt 21; a temperature sensor 27 as a temperature detector for detecting the temperature of the fixing belt 21; a separating member 28 for separating a sheet of paper from the fixing belt 21; a pressing unit, which is not illustrated, for pressing the pressing roller 22 against the fixing belt 21; and the like.

The fixing belt 21 includes a thin and flexible endless-form belt member (including a film). More specifically, the fixing belt 21 includes a base material on the inner peripheral side formed using a metal material such as nickel or SUS or a resin material such as polyimide (PI), and a mold release layer on the outer peripheral side formed using tetrafluoroethylene-perfluoroalkylvinylether copolymer (PFA), polytetrafluoroethylene (PTFE) or the like. Between the base material and the mold release layer may be provided an elastic layer formed using a rubber material such as silicone rubber, expandable silicone rubber, or fluorine rubber.

The pressing roller 22 includes: a core metal 22*a*; an elastic layer 22*b* including expandable silicone rubber, silicone rubber, fluorine rubber, or the like provided for a surface of the core metal 22*a*; and a mold release layer 22*c* including PFA, PTFE, or the like provided for a surface of the elastic layer 22*b*. The pressing roller 22 is pressed toward the fixing belt 21 by a pressing unit, which is not illustrated, to abut on the nip forming member 24 via the fixing belt 21. At a portion where the pressing roller 22 and the fixing belt 21 are brought into contact with each other by being pressed, the elastic layer 22*b* of the pressing roller 22 is crushed to form a nip portion N with predetermined width. Moreover, the pressing roller 22 is configured to rotate and drive on a drive source such as a motor, which is not illustrated, provided for the printer body. Along with the rotation and drive of the pressing roller 22, the drive power transmits to the fixing belt 21 through the nip portion N, followed by the rotation of the fixing belt 21.

Although the pressing roller 22 is a solid roller in this embodiment, the pressing roller 22 may be a hollow roller. In that case, the heat source such as the halogen heater may be disposed inside the pressing roller 22. In the case where there is no elastic layer, the heat capacity is reduced to increase the fixing property; however, there is a risk that microscopic unevenness on the surface of the belt is transferred to the image through fixation from the crush of the unfixed toner to cause gloss unevenness on a plain part of the image. In order to prevent this, an elastic layer with a thickness of 100 μm or more is desirably provided. By the provision of the elastic layer with a thickness of 100 μm or more, the elastic deformation of the elastic layer can absorb the microscopic unevenness, so that the occurrence of the gloss unevenness can be avoided. The elastic layer 22*b* may be solid rubber and, when the heat source is not provided inside the pressing roller 22, may be sponge rubber. The use of sponge rubber is more desirable because the heat insulation property is increased to make it difficult to take the heat off from the fixing belt 21. The fixing belt 21 and the pressing roller 22 may have a configuration in which they are simply in contact with each other instead of being in contact with each other through pressure application.

The halogen heater 23 is fixed with its both ends on side plates (not illustrated) of the fixing device 20. Each halogen heater 23 is configured to generate heat while the output thereof is controlled by a power source part provided for the printer body. The output control is performed based on a detection result of the surface temperature of the fixing belt 21 from the temperature sensor 27. Through the output control of the halogen heater 23, the temperature of the fixing belt 21 (fixing temperature) can be set at a desired temperature. As the heat source for heating the fixing belt 21, an IH, a resistive heater, a carbon heater, or the like may be used instead of the halogen heater.

The nip forming member 24 includes a base pad 241, and a slidable sheet (low-friction sheet) 240 provided for a surface of the base pad 241. The base pad 241 is disposed in a rectangular form in the axial direction of the fixing belt 21 or the axial direction of the pressing roller 22, and determines the shape of the nip portion N by receiving the pressure force from the pressing roller 22. The base pad 241 is fixed and supported by the stay 25. This prevents the nip forming member 24 from being bent by the pressure from the pressing roller 22, and allows the nip to have uniform width in the axial direction of the pressing roller 22. For satisfying the anti-bending function for the nip forming member 24, the stay 25 is desirably formed using a metal material with high mechanical strength, such as stainless steel or iron. The base pad 241 is also desirably formed using a material with a certain degree of hardness for securing the strength. As the material of the base pad 241, a resin such as liquid crystal polymer (LCP), metal, ceramic, or the like can be used. The plane of the base pad 241 that faces the pressing roller 22 is formed to be a flat-surface form, and therefore the nip portion N is formed to have a straight form. By the straight form of the nip portion N, the pressure force applied by the pressing roller 22 can be reduced.

The base pad 241 includes a heat-resistant member that can resist the heat with a temperature of 200° C. or more. This prevents the nip forming member 24 from being thermally deformed in the toner fixing temperature range, thereby securing the stable state of the nip portion N and stabilizing the output image quality. For the nip forming member 24, a general heat-resistant resin can be used such as polyether sulfone (PES), polyphenylene sulfide (PPS), liquid crystal polymer (LCP), polyether nitrile (PEN), polyamide-imide (PAI), or polyether ether ketone (PEEK).

The slidable sheet 240 may be disposed on at least a surface of the base pad 241 that faces the fixing belt 21. Thus, during the rotation of the fixing belt 21, the drive torque of the fixing belt 21 is reduced by the slide of the fixing belt 21 relative to the low-friction sheet, thereby reducing the load caused due to the friction power on the fixing belt 21. The slidable sheet 240 may be omitted in the configuration.

The reflecting member 26 is disposed between the stay 25 and the halogen heater 23. In this embodiment, the reflecting member 26 is fixed to the stay 25. The material of the reflecting member 26 is aluminum, stainless steel, or the like. By the provision of the reflecting member 26 in this manner, the light emitted from the halogen heater 23 toward the stay 25 is reflected to the fixing belt 21. Accordingly, the amount of light delivered to the fixing belt 21 can be increased, so that the fixing belt 21 can be efficiently heated. Moreover, the transmission of the radiation heat from the halogen heater 23 to the stay 25 or the like can be suppressed, thereby saving the energy.

For further saving energy and improving the first printing time and the like, various configuration devices are made on the fixing device 20 according to this embodiment.

Specifically, the fixing belt 21 is directly heated at a portion other than the nip portion N by the halogen heater 23 (direct heating method). In this embodiment, nothing is provided between the halogen heater 23 and the left part of the fixing belt 21 in FIG. 2, so that the radiation heat from the halogen heater 23 is directly applied to that portion of the fixing belt 21.

Further, for reducing the heat capacity of the fixing belt 21, the fixing belt 21 is reduced in thickness and diameter. Specifically, the thicknesses of the base material, the elastic layer, and the mold release layer of the fixing belt 21 are set in the range of 20 to 50 μm, 100 to 300 μm, and 10 to 50 μm, respectively, so that the total thickness is set to 1 mm or less. Further, the diameter of the fixing belt 21 is set in the range of 20 to 40 mm. For further reducing the heat capacity, the total thickness of the fixing belt 21 is desirably set to 0.2 mm or less, more desirably 0.16 mm or less. The diameter of the fixing belt 21 is desirably 30 mm or less.

In this embodiment, the diameter of the pressing roller 22 is set in the range of 20 to 40 mm, so that the diameter of the fixing belt 21 and the diameter of the pressing roller 22 are equivalent to each other. However, the configuration is not limited to this. For example, the diameter of the fixing belt 21 may be smaller than that of the pressing roller 22. In this case, the radius of curvature of the fixing belt 21 at the nip portion N is smaller than that of the pressing roller 22, whereby the recording medium discharged from the nip portion N is easily separated from the fixing belt 21.

As a result of reducing the diameter of the fixing belt 21 as above, the space inside the fixing belt 21 is reduced; however, when the stay 25 is formed to have a concave shape in which the both sides are folded, and houses the halogen heater 23 inside the concave shape, the stay 25 and the halogen heater 23 can be disposed inside the small space.

In order to dispose the stay 25 as large as possible in the small space, the nip forming member 24 is formed to be small, on the contrary. Specifically, the width of the base pad 241 in the paper conveying direction is made smaller than the width of the stay 25 in the paper conveying direction. Moreover, in FIG. 2, $h1 \leq h3$ and $h2 \leq h3$ are satisfied in the configuration where: h1 and h2 represent the heights of an upstream side end part 24*a* and a downstream side end part 24*b* of the base pad 241 in the paper conveying direction from the nip portion N or its virtual extension line E, respectively; and h3 represents the maximum height of a part of the base pad 241 other than the upstream side end part 24*a* and the downstream side end part 24*b* from the nip portion N or its virtual extension line E. By the configuration as above, the upstream side end part 24*a* and the downstream side end part 24*b* of the base pad 241 do not exist between the fixing belt 21 and each folded part of the stay 25 on the upstream side and the downstream side in the paper conveying direction; therefore, each folded part can be disposed close to the inner peripheral surface of the fixing belt 21. This allows the stay 25 to be disposed as large as possible in the limited space in the fixing belt 21, and secures the strength of the stay 25. As a result, the bending of the nip forming member 24 by the pressing roller 22 can be prevented and the fixing property can be improved.

For further securing the strength of the stay 25, in this embodiment, the stay 25 includes a base part 25*a* extending in the paper conveying direction (upward and downward in FIG. 2) in contact with the nip forming member 24, and a rising part 25*b* extending from each end of the base part 25*a* on the upstream side and the downstream side in the paper conveying direction toward the abutting direction of the pressing roller 22 (to the left side in FIG. 2). That is to say, by the provision of the rising part 25*b* in the stay 25, the stay 25 comes to have a horizontally long cross section extending in the pressing direction of the pressing roller 22, so that the section modulus is increased to improve the mechanical strength of the stay 25.

The strength of the stay 25 is improved when the rising part 25*b* is formed longer in the abutting direction of the pressing roller 22. A leading end of the rising part 25*b* desirably faces the inner peripheral surface of the fixing belt 21 as close as possible. However, the rotation involves a certain degree of vibration (disorder of behavior) of the fixing belt 21; therefore, when the leading end of the rising part 25*b* is too close to the inner peripheral surface of the fixing belt 21, there is a risk that the fixing belt 21 touches the leading end of the rising part 25*b*. In particular, in the configuration including the thin fixing belt 21 as in this embodiment, the vibration of the fixing belt 21 is intense; in this case, the position of the leading end of the rising part 25*b* needs to be carefully set.

Specifically, in this embodiment, the distance d between the leading end of the rising part 25*b* and the inner peripheral surface of the fixing belt 21 in the abutting direction of the pressing roller 22 is preferably at least 2.0 mm, desirably 3.0 mm or more. Meanwhile, when the fixing belt 21 is thick to some extent to cause almost no vibration, the distance d can be set to 0.02 mm. When the reflecting member 26 is attached to the leading end of the rising part 25*b* as in this embodiment, the distance d needs to be set so that the reflecting member 26 does not touch the fixing belt 21.

By disposing the leading end of the rising part 25*b* as close as possible to the inner peripheral surface of the fixing belt 21, the rising part 25*b* can be disposed long in the abutting direction of the pressing roller 22. Thus, even in the configuration including the fixing belt 21 with small diameter, the mechanical strength of the stay 25 can be improved.

Figure 3A:
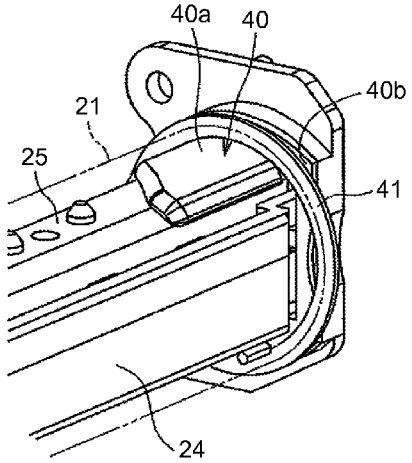
FIGS. 3A to 3C illustrate the configuration of an end part of a fixing belt in an axial direction, FIG. 3A corresponds to a perspective view, FIG. 3B corresponds to a plan view, and FIG. 3C corresponds to a radial sectional view.
Figure 3B:
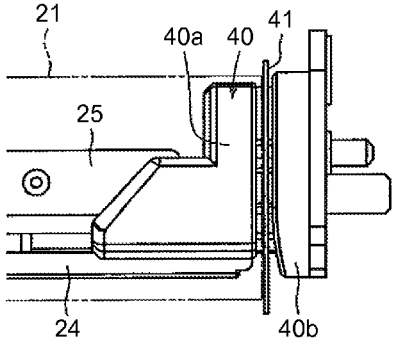
Figure 3C:
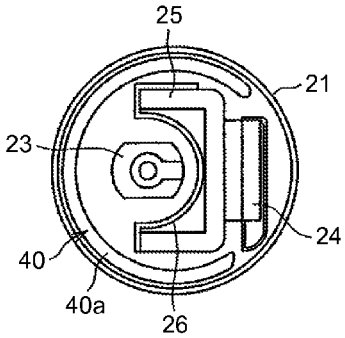

FIGS. 3A to 3C illustrate the configuration of the end part of the fixing belt. Of FIGS. 3A to 3C, FIG. 3A corresponds to a perspective view, FIG. 3B corresponds to a plan view, and FIG. 3C corresponds to a side view taken along a rotation axis direction of the fixing belt. Although FIGS. 3A to 3C illustrate only the configuration of the end part on one side, the opposite side also has the similar structure, so that the description is made of just the end part on one side based on FIGS. 3A to 3C below.

As illustrated in FIG. 3A or 3B, a belt holding member 40 is inserted at each end of the fixing belt 21 in the axial direction. The belt holding member 40 includes integrally a cylindrical part 40*a* whose external peripheral surface forms a partially cylindrical form, and a flange part 40*b* with a larger diameter than the cylindrical part. As illustrated in FIG. 3C, the cylindrical part 40*a* of the belt holding member 40 is formed like a letter of C, opening at a position of the nip portion N (where the nip forming member 24 is disposed). The cylindrical part 40*a* is loosely fitted into the inner peripheral surface of the fixing belt 21, so that the cylindrical part 40*a* rotatably holds the end part of the fixing belt 21. The position of the end part of the stay 25 is determined by being fixed by the belt holding member 40.

Because of forming the nip portion N in the straight form as above, the force that changes the shape into an elliptical shape having a minor axis in a normal direction of the nip portion N operates normally on the fixing belt 21. This increases the distortion in the fixing belt 21 and repeatedly deforms the belt along with the change of radius of curvature during the rotation; therefore, unless making any particular countermeasure, a crack or the like might occur starting from the end of the fixing belt 21 to drastically deteriorate the durability of the fixing belt 21. In contrast, when each end part of the fixing belt 21 is held by the belt holding member 40 to restrict the cross section of the fixing belt 21 at each end part to be circular, the trouble as above can be prevented.

As illustrated in FIG. 3A or 3B, a slip ring 41 as a protective member for protecting the end part of the fixing belt 21 is provided between an end face of the fixing belt 21 in the axial direction and the surface of the belt holding member 40 that faces the end face of the fixing belt (end face of the flange part 40*b*). Accordingly, when the deviation occurs in the fixing belt 21 in the axial direction, the end part of the fixing belt 21 can be prevented from directly abutting on the belt holding member 40 and the frictional wear and damage of the end part can be prevented. Since the slip ring 41 is fitted with a margin to the outer periphery of the cylindrical part 40*a* of the belt holding member 40, the slip ring 41 can be rotated together with the fixing belt 21 when the end part of the fixing belt 21 touches the slip ring 41. On this occasion, the slip ring 41 is not necessarily rotated together but may stand still. For the material of the slip ring 41, a material with excellent heat resistance, for example, super engineer plastic, such as PEEK, PPS, PAI, or PTFE is preferable.

Although not illustrated, a blocking member for blocking heat from the halogen heater 23 is provided between the fixing belt 21 and the halogen heater 23 at each end part of the fixing belt 21 in the axial direction. This can suppress excessive temperature rise in a paper non-feeding region of the fixing belt during the successive paper feeding, and prevent thermal deterioration or damage of the fixing belt.

A basic operation of the fixing device according to this embodiment is described with reference to FIG. 2. By turning on a power supply switch of the printer body, the power is supplied to the halogen heater 23 and the pressing roller 22 starts to rotate and drive clockwise in FIG. 2. Thus, the fixing belt 21 is rotated accordingly counterclockwise by the friction power with the pressing roller 22 in FIG. 2.

After that, the paper P carrying an unfixed toner image T is conveyed in the aforementioned image forming process in an arrow A1 direction of FIG. 2 while the paper P is guided by a guide plate, which is not illustrated, and sent into the fixing belt 21 and the nip portion N of the pressing roller 22 in the pressure contact state. With the heat of the fixing belt 21 heated by the halogen heater 23 and the pressure force between the fixing belt 21 and the pressing roller 22, the toner image T is fixed on the surface of the paper P.

The paper P with the toner image T fixed thereon is conveyed in an arrow A2 direction in FIG. 2 from the nip portion N. On this occasion, the paper P is separated from the fixing belt 21 by bringing the leading end of the paper P in contact with a leading end 28*a* of the separating member 28. After that, the separated paper P is discharged out of the machine by the discharge rollers and stored in the discharge tray as described above.

Figure 5A:
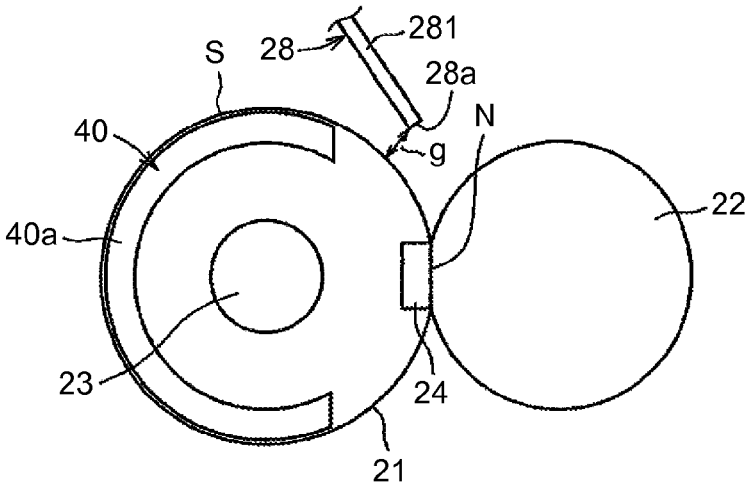
FIGS. 5A and 5B represent the relation between the fixing belt and the separating member, FIG. 5A corresponds to a radial sectional view in the vicinity of an end part of the fixing belt and FIG. 5B corresponds to a radial sectional view in the vicinity of a center of the fixing belt in the axial direction.
Figure 5B:
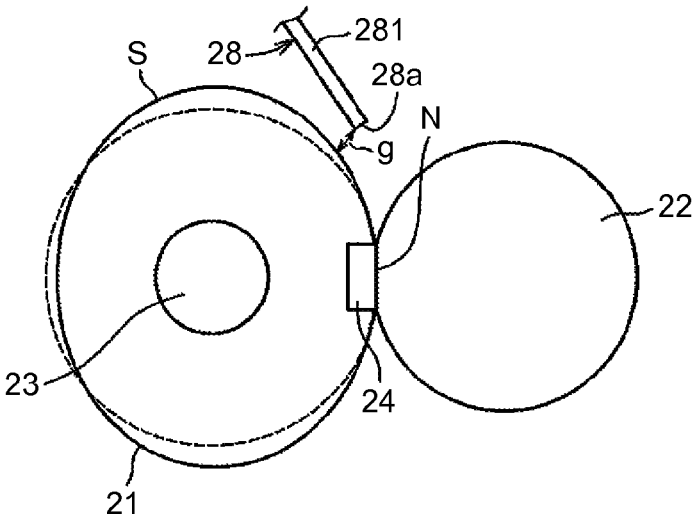

By the way, only each end of the fixing belt 21 with the above configuration is held by the belt holding member 40; therefore, the fixing belt 21 between the both ends is in a freely deformable state except the nip portion N. Moreover, because of forming the nip portion N in the straight form, the force that changes the shape into an elliptical shape operates normally on the fixing belt 21. Therefore, during the rotation of the fixing belt 21, the radial cross section is almost circular at the both ends of the fixing belt 21 as illustrated in FIG. 5A but is deformed to be elliptical in the other parts as illustrated in FIG. 5B. The degree of deformation ranging from the circular to elliptical shape increases gradually from the both ends of the fixing belt 21 toward the center thereof in the axial direction. In the configuration in which the radial cross section of the fixing belt changes in the axial direction during the rotation in this manner, the separation gap g between the leading end 28*a* of the separating member 28 and a surface S of the fixing belt 21 facing the leading end 28*a* changes in the axial direction. Specifically, the width $T_a$ (see FIG. 5A) at the both ends of the fixing belt 21 in the axial direction becomes larger than the width $T_b$ (see FIG. 5B) at the center in the axial direction. When the width of the separation gap g varies in this manner in the axial direction, jam might occur due to the separation failure or damage of the fixing belt 21 (generation of abnormal image) might occur due to the contact with the separating member 28, for example.

The configuration of the separating member 28 in which the countermeasure against the above problem has been done is described below.

Figure 4:
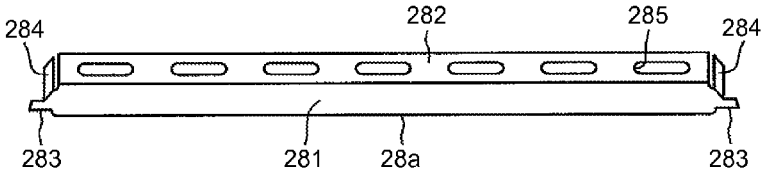
FIG. 4 is a perspective view of a separating member.

The separating member 28 is a rectangular member extending in the axial direction, and includes a plate-like separating unit 281 and a plate-like standing part 282 extending from one end of the separating unit in a direction orthogonal thereto, thereby forming a section with a shape like a letter of L as illustrated in FIG. 4. The standing part 282 includes a plurality of holes 285. At each end of the separating member 28, an abutting part 283 and a bracket part 284 are integrally formed. By detachably attaching the bracket part 284 to a pin (not illustrated) installed in a protruding manner in the device body, the separating member 28 is rotatably supported with an axis O (see FIG. 2) used as a center in the axial direction. By abutting the abutting part 283 on, for example, the flange part 40*b* of the belt holding member 40, the separating member 28 is positioned relative to the nip portion N. In this positioned state, as illustrated in FIG. 2, the separating unit 281 of the separating member 28 extends in the direction of approaching the nip portion N, and the separation gap g is formed between the leading end 28*a* and the surface S of the fixing belt 21. The thickness of a leading end 23*a* of the separating unit 281 is constant in the axial direction.

Figure 6:
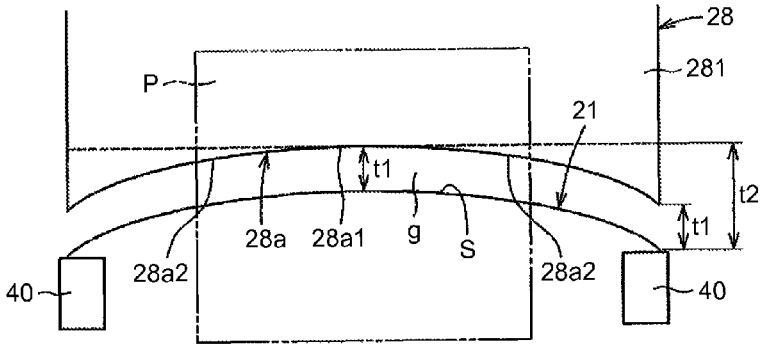
FIG. 6 is a front view of the separating member according to an embodiment.
Figure 7:
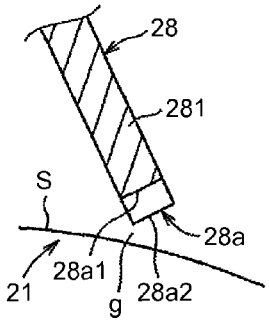
FIG. 7 is an expanded sectional view of the leading end of the separating member in the center in the axial direction.

FIG. 6 and FIG. 7 are a front view of the separating member (a view seen in a normal direction of the surface of the separating unit 281) and a sectional view of the vicinity of the leading end 28*a* at the center of the separating unit 281 in the axial direction, respectively. As is clear from FIGS. 5A and 5B, the separation gap g does not exist on the same plane as the surface of the separating unit 281 in fact; however, for the convenience of the description, the corresponding separation gap g is illustrated after being moved onto the same plane as the surface of the separating unit 281 in FIG. 6 (this applies to FIG. 8, too).

As illustrated in FIG. 6 and FIG. 7, the leading end 28*a* of the separating member 28 is provided with a receding portion 28*a*1 and approaching portions 28*a*2 whose positions in the axial direction are different. The receding portion 28*a*1 is located receding from the nip portion N along the direction of extending the separating member 28 (particularly the separating unit 281) toward the nip portion N, and the approaching portion 28*a*2 are located approaching the nip portion N as compared with the receding portion 28*a*1 along the same direction. In FIG. 6, for helping the understanding, the illustration of the maximal width L between the receding portion 28*a*1 and the approaching portion 28*a*2 is exaggerated.

In the separating member 28 in this embodiment, the approaching portion 28*a*2 is disposed on each side of the receding portion 28*a*1 in the axial direction. The receding portion 28*a*1 and the approaching portions 28*a*2 form a curved line (strictly, curved surface) and the both are continuous smoothly. Therefore, the leading end 28*a* of the separating member 28 forms a concave curved line with the center in the axial direction receding. The shape dimensions of the receding portion 28*a*1 and the approaching portions 28*a*2 are determined so that the curved line of the leading end 28*a* coincides with the shape of the surface S (convex curved line) facing the leading end 28*a* via the separation gap in the fixing belt 21 in the rotation.

In the case where the leading end 28*a* of the separating member 28 is formed like a single straight line in the axial direction like conventionally as illustrated by a dashed line in FIG. 6, the width t2 of the separation gap at each end of the fixing belt 21 is much larger than the width t1 of the separation gap at the center in the axial direction. In contrast, when the leading end 28*a* of the separating member 28 is formed like a concave curved line as illustrated by a solid line, the separation gap t1 can be uniformed entirely in the axial direction of the separating member 28. Therefore, the occurrence of jam due to the separation failure, damage of the fixing belt 21 due to the contact with the separating member 28, the occurrence of abnormal images due to this damage, and the like can be prevented.

The embodiment illustrated in FIG. 6 exemplified the case where the entire leading end 28*a* of the separating member 28 is formed like a concave curved line; however, the shape of the leading end 28*a* outside the region where the paper P passes is arbitrary, and for example, the leading end 28*a* outside the region may be formed like a straight line in the axial direction.

Figure 8:
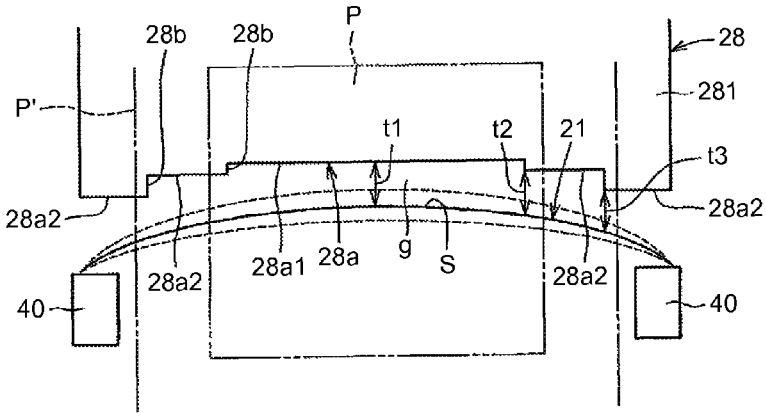
FIG. 8 is a front view of a separating member according to another embodiment.

FIG. 8 illustrates another embodiment of the separating member 28. In this embodiment, in a manner similar to the embodiment illustrated in FIG. 6, the leading end 28*a* of the separating member 28 is provided with the receding portion 28*a*1 receding from the nip portion N and the approaching portions 28*a*2 approaching the nip portion N, and the approaching portion 28*a*2 is disposed on each side of the receding portion 28*a*1 in the axial direction. Meanwhile, differently from the embodiment illustrated in FIG. 6, the receding portion 28*a*1 and the approaching portions 28*a*2 are both formed like a straight line in the axial direction and the both are connected via a level difference 28*b*.

By forming the leading end 28*a* of the separating member 28 like a stepped straight form and disposing the approaching portion 28*a*2 on each side of the receding portion 28*a*1 in the axial direction, the shape of the leading end 28*a* can be approximated to the concave curved line corresponding to the shape (convex curved line) of the surface S of the fixing belt 21. Thus, the variation in separation gap g can be decreased and, in a manner similar to the embodiment illustrated in FIG. 6; the occurrence of jam due to the separation failure, damage of the fixing belt 21 due to the contact with the separating member 28, and the occurrence of abnormal images can be prevented. In the embodiment illustrated in FIG. 6, the width t1 of the separation gap g is uniform, so that the separation property is excellent; however, the dimension measurement and the dimension management of the leading end 28*a* are difficult. In contrast, the leading end 28*a* with the shape illustrated in FIG. 8 can solve this kind of trouble.

In the embodiment illustrated in FIG. 8, both the receding portion 28*a*1 and the approaching portions 28*a*2 are disposed in the region where the paper P passes. In this case, it is enough as long as at least apart (inner part) of the approaching portion 28*a*2 is disposed in the region where the paper P passes. For example, the level difference 28*b* is positioned displaced by 5 mm inward from each end of the paper P. Even in the above configuration, the difference between the minimal width t2 of the separation gap g at each end of the paper P and the minimal width t1 of the separation gap g at the center of the paper P in the axial direction can be reduced and the operation effect similar to the above can be obtained. By making the minimal widths t1 and t2 coincide with each other, the separation property can be further improved.

As illustrated in FIG. 8, the approaching portions 28*a*2 can be provided at multiple locations (two in the drawing) on each of one side and the other side in the axial direction of the receding portion 28*a*1. In this case, the approaching portion 28*a*2 on the outside projects in a direction approaching the nip portion N as compared with the approaching portion 28*a*2 on the inside. Thus, as compared with the case where the approaching portion 28*a*2 is disposed on each side of the receding portion 28*a*1 in the axial direction, the approximation of the leading end 28*a* of the separating member 28 for the shape of the surface S of the fixing belt 21 can be increased, and the variation in minimal widths t1, t2, and t3 of the separation gap g at the parts 28*a*1 and 28*a*2 can be further suppressed, thereby improving the separation property further. By making all the minimal widths t1, t2, and t3 coincide with each other, the separation property is further increased.

As illustrated in FIG. 8, when the receding portion 28*a*1 and all the approaching portions 28*a*2 are disposed in the region where paper P' with larger width than the paper P passes, the variation in separation gap g can be prevented for each of paper P and P' with different widths; thus, the stable separation property can be secured for various paper P with different sizes. In this case, it is enough as long as at least a part of the approaching portion 28*a*2 on the outside is located in the region where the paper P' passes.

When the rotation speed of the fixing belt 21 is increased or decreased as illustrated by a dashed line in FIG. 8, the surface shape S of the fixing belt 21 also changes accordingly (the swelling of the fixing belt 21 increase as the rotation speed increases). Accordingly, it is necessary to design the shape of the leading end 28*a* of the separating member 28 or the position of the separating member 28, for example, so that each of the minimal widths t1, t2, and t3 is greater than or equal to the necessary minimal width as the separation gap g even when the rotation speed is the maximal.

Figure 9:
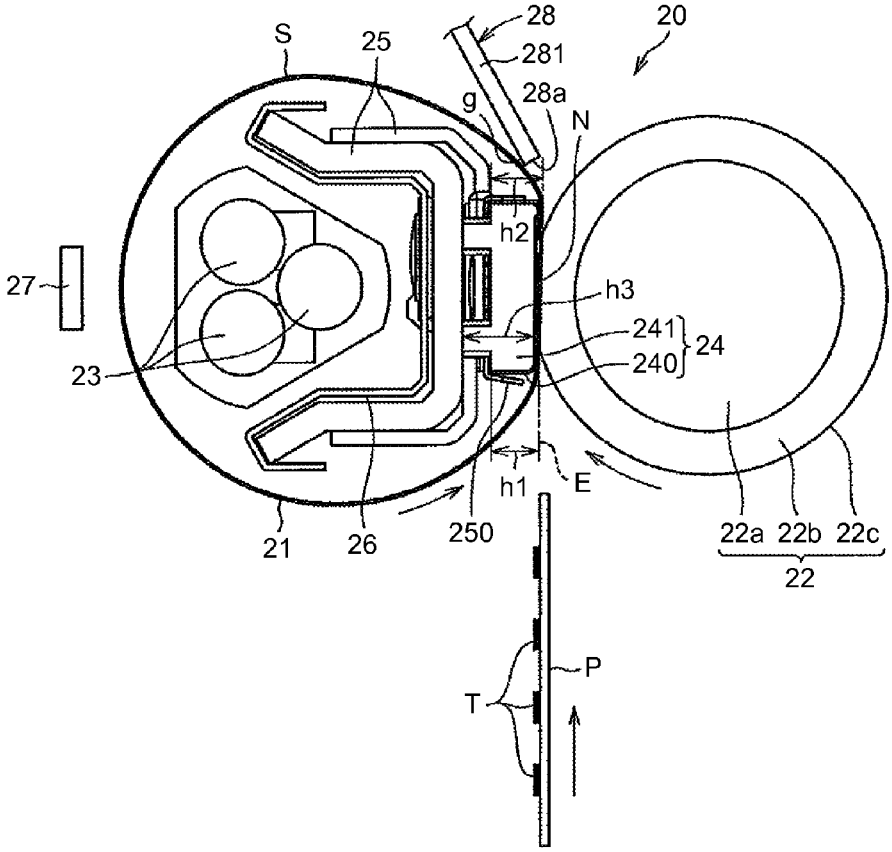
FIG. 9 is a sectional view illustrating another embodiment of the fixing device.

FIG. 9 illustrates another embodiment of the fixing device 20. The fixing device 20 according to this embodiment includes three of the halogen heaters 23 as a heat source. In this case, by differentiating the heat generation region for each halogen heater 23, the fixing belt 21 can be heated in the range corresponding to various paper widths. In this case, also, a sheet metal 250 is provided surrounding the nip forming member 24; the nip forming member 24 is supported by the stay 25 through this sheet metal 250. The configuration other than this is basically similar to the configuration of the above embodiment illustrated in FIG. 2.

In this embodiment, in a manner similar to the above embodiments illustrated in FIG. 6 and FIG. 8, the leading end 28*a* of the separating member 28 is provided with the receding portion 28*a*1 receding from the nip portion N and the approaching portions 28*a*2 approaching the nip portion N, and the approaching portion 28*a*2 is disposed at each side of the receding portion 28*a*1 in the axial direction. This can suppress the variation in separation gap g in a manner similar to the above embodiments.

The features of the separating member 28 and the fixing device 20 described above are as follows.

The leading end 28*a* of the separating member 28 is provided with the receding portion 28*a*1 and the approaching portions 28*a*2 which are different in position from the receding portion 28*a*1 in the axial direction, and the approaching portions 28*a*2 are disposed approaching the nip portion N along the extending direction of the separating member 28 as compared with the receding portion 28*a*1; therefore, the shape of the leading end 28*a* of the separating member 28 can be set corresponding to the shape of the surface S of the rotating fixing belt 21 by adjusting the positional relation between the receding portion 28*a*1 and the approaching portion 28*a*2 or the individual shape as appropriate. Therefore, even in the case where the radial section of the rotating fixing belt 21 is different in multiple locations in the axial direction, the variation in separation gap g between the leading end 28*a* of the separating member 28 and the surface S of the fixing belt 21 can be reduced or the separation gap g can be uniformed. Thus, the occurrence of jam in the fixing device 20 can be prevented, or the damage of the fixing belt 21 due to the contact with the separating member 28, and moreover the image abnormality can be prevented.

By disposing the approaching portion 28*a*2 on each side of the receding portion 28*a*1 in the axial direction, only each end part of the fixing belt 21 is held by the belt holding member 40; therefore, even when the both ends of the fixing belt 21 become circular and the portion between the both ends is deformed into an elliptical shape, variation in separation gap g can be suppressed for sure.

By disposing the receding portion 28*a*1 and the approaching portions 28*a*2 in the region where the paper P passes, variation in separation gap at least in the region where the paper P passes can be prevented, thereby improving the separation property.

As long as the receding portion 28*a*1 and the approaching portions 28*a*2 are each formed like a curved line and the both are formed to continue smoothly, the shape of the leading end 28*a* of the separating member 28 can be approximated to the shape of the surface S of the fixing belt 21 by determining the shapes of the receding portion 28*a*1 and the approaching portions 28*a*2 as appropriate.

In this case, the separation property of the separating member 28 is further increased by forming the receding portion 28*a*1 and the approaching portions 28*a*2 so that the separation gaps g from the fixing belt surface S during the rotation facing those parts are equal to each other.

By forming the receding portion 28*a*1 and the approaching portions 28*a*2 each like a straight line in the axial direction, the dimension measurement and dimension management of the leading end 28*a* of the separating member 28 can be facilitated and the quality of the separating member 28 at mass production can be stabilized.

In this case, variation in separation gap g can be suppressed practically sufficiently by forming the receding portion 28*a*1 and the approaching portions 28*a*2 so that the minimal widths t1, t2, and t3 of the separation gap from the fixing belt surface S facing those parts during the rotation are equal to each other. Moreover, by providing the plural approaching portions 28*a*2 with a different amount of approaching the nip portion M for each of one side and the other side of the receding portion 28*a*1 in the axial direction, the approximation of the leading end 28*a* of the separation member for the surface of the fixing belt 21 is increased and the separation property is improved, so that the variation in separation gap to the various P and P' with different paper widths can be suppressed and excellent separation property is obtained.

Second Embodiment

Next, a configuration example different from the configuration of the separating member 28 of the first embodiment is described. Note that since the configurations of the image forming device and the fixing device are the same as those of the first embodiment described above, the redundant description is not made by giving the same reference symbols. The configuration of the separating member 28 according to the second embodiment is described below.

Figure 10A:
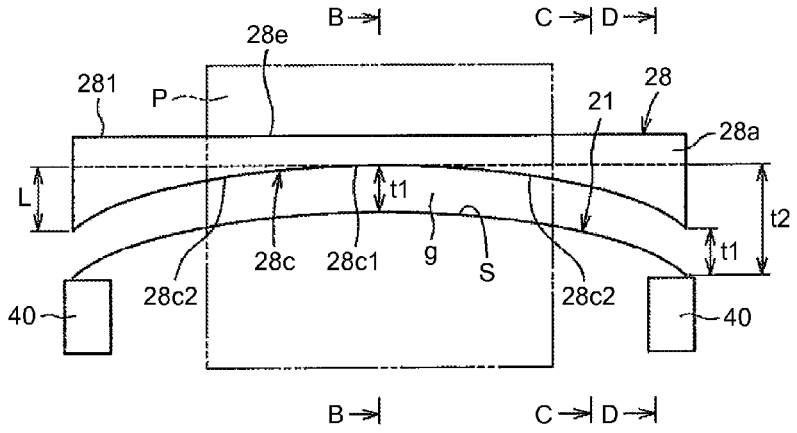
FIGS. 10A to 10D are explanatory views illustrating the configuration of a separating member according to a second embodiment, FIG. 10A corresponds to a front view seen in a direction where the separating unit extends, FIG. 10B corresponds to a sectional view taken along line B-B in FIG. 10A, FIG. 10C corresponds to a sectional view taken along line C-C in FIG. 10A, and FIG. 10D corresponds to a sectional view taken along line D-D in FIG. 10A.
Figure 10B:
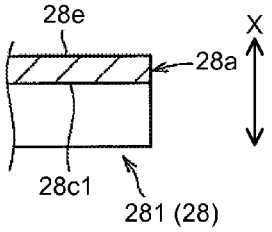
Figure 10C:
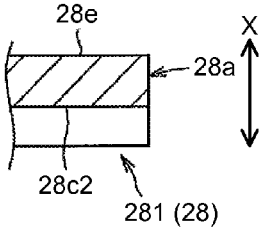
Figure 10D:
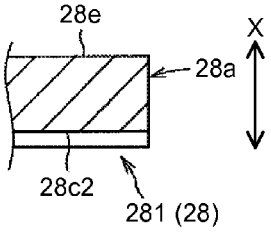
Figure 11A:
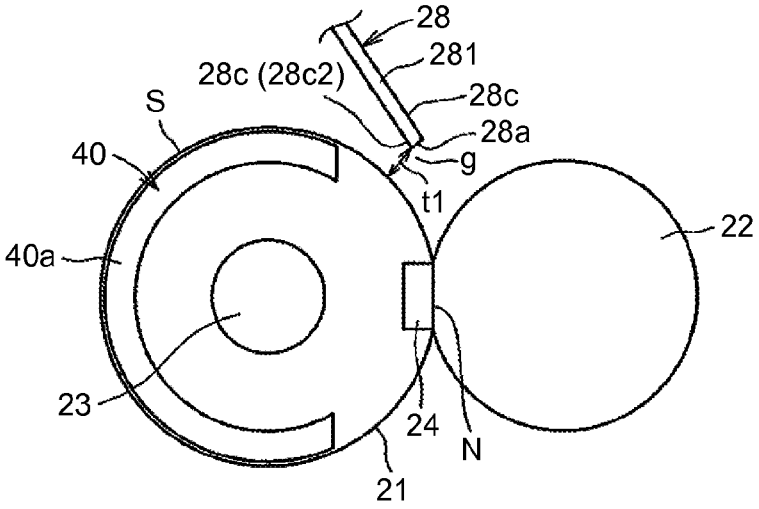
FIGS. 11A and 11B represent the relation between the separating member and the fixing belt according to the second embodiment, FIG. 11A corresponds to a radial sectional view in the vicinity of the end part of the fixing belt, and FIG. 11B corresponds to a radial sectional view in the center of the fixing belt in the axial direction.
Figure 11B:
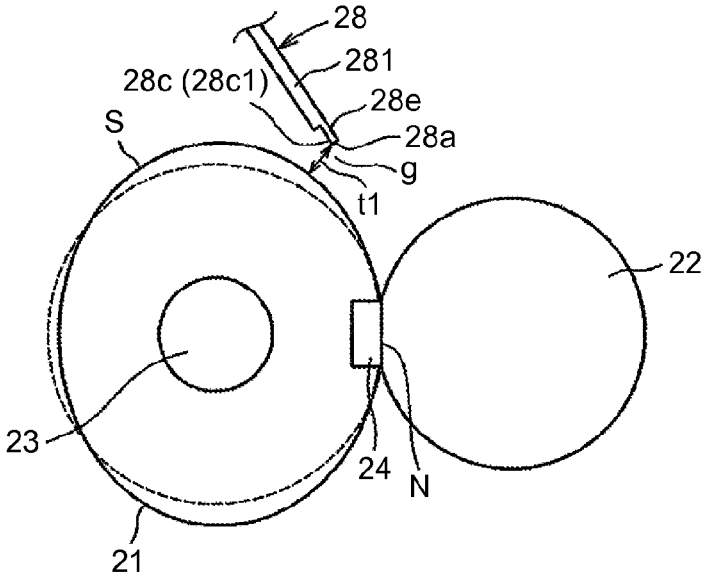

FIG. 10A is a front view (so is FIG. 12A) of the separating member 28 according to the second embodiment seen in a direction where the separating unit 281 extends. FIG. 10B is a sectional view taken along line B-B in FIG. 10A, FIG. 10C is a sectional view taken along line C-C in FIG. 10A, and FIG. 10D is a sectional view taken along line D-D in FIG. 10A. Moreover, FIGS. 11A and 11B are sectional views representing the relation between the separating member 28 and the fixing belt 21. FIG. 11A is the sectional view at each end part of the fixing belt 21 in the axial direction; FIG. 11B is the sectional view at the center of the fixing belt 21 in the axial direction.

As illustrated in FIGS. 10A to 10D and FIGS. 11A and 11B, the leading end 28*a* of the separating member 28 is provided with a gap forming surface 28*c* facing the surface S of the fixing belt 21 and forming the separation gap g from the surface S. The thickness of the gap forming surface 28*c* varies in the axial direction, and the gap forming surface 28*c* is provided with a receding portion 28*c*1 and projecting portions 28*c*2 whose positions in the axial direction are different. The receding portion 28*c*1 is disposed apart from the surface S of the fixing belt 21 in a direction (X direction in FIG. 10B) of the thickness of the leading end 28*a* of the separating member 28 (separating unit 281), and the projecting portions 28*c*2 are disposed approaching the surface S of the fixing belt 21 in the thickness direction X as compared with the receding portion 28*c*1. An external surface 28*e* positioned on the side of the separating unit 281 opposite to the gap forming surface 28*c* is formed in a flat surface form, and therefore, the leading end 28*a* of the separating unit 281 is thinner in the receding portion 28*c*1 than in the projecting portion 28*c*2. Note that in FIGS. 10A to 10D, for helping the understanding, the illustration of the maximal width L between the receding portion 28*c*1 and the projecting portion 28*c*2 is exaggerated; the actual maximal width L is in the range of 0.1 mm to 1.0 mm.

In the separating member 28 of this embodiment, the projecting portion 28*c*2 is disposed at each side of the receding portion 28*c*1 in the axial direction. The receding portion 28*c*1 and the projecting portions 28*c*2 each form a curved surface with a radius of curvature in the radial direction, and the both are continuous smoothly. Therefore, the gap forming surface 28*c* of the leading end 28*a* of the separating member 28 has a mode of a concave curved surface with the center in the axial direction receding. The shape dimensions of the receding portion 28*c*1 and the projecting portions 28*c*2 are determined so that the curved surface shape of the gap forming surface 28*c* coincides with the shape (convex curved surface) of the surface S of the fixing belt 21 in the axial direction that faces the gap forming surface 28*c* via the separation gap g. In this case, the border between the receding portion 28*c*1 and the projecting portion 28*c*2 can be set arbitrarily; for example, in FIGS. 6A to 6D, the border is taken in the vicinity of C-C section, and a part of the gap forming surface 28*c* on the end part side in the axial direction beyond the border is used as the projecting portion 28*c*2 and a part of the gap forming surface on the center side in the axial direction beyond the boarder is used as the receding portion 28*c*1.

As illustrated by a dashed line in FIG. 10A, when the gap forming surface 28*c* of the separating member 28 is formed in a flat surface form like conventionally, the width t2 of the separation gap at the both ends of the fixing belt 21 is much larger than the width t1 of the separation gap g at the center in the axial direction. In contrast, as illustrated by a solid line, when the gap forming surface 28*c* of the separating member 28 is formed in a concave curved surface form, the width t1 of the separation gap g can be uniformed over the entire separating member 28 in the axial direction. Therefore, the occurrence of jam due to the separation failure, damage of the fixing belt 21 due to the contact with the separating member 28, occurrence of abnormal images due to this damage, and the like can be prevented. The shape of the separating unit 281 can be selected arbitrarily as long as the projecting portion 28*c*2 projects to the surface side of the fixing belt 21 along the thickness direction X of the leading end 28*a* of the separating member as compared with the receding portion 28*c*1.

Moreover, the embodiments illustrated in FIGS. 10A to 10D have described the case where the entire gap forming surface 28*c* of the separating member 28 is formed in a concave surface form in the axial direction; however, the shape of the gap forming surface 28*c* other than the region where the paper P passes is arbitrary. For example, the gap forming surface 28*c* other than the passing region may be formed in a flat surface form extending in the axial direction.

Other embodiments of the separating member 28 are described with reference to FIGS. 12A to 12D. In a manner similar to the embodiments illustrated in FIGS. 10A to 10D, in this embodiment, the leading end 28*a* of the separating member 28 is provided with the receding portion 28*c*1 and the projecting portions 28*c*2 with positions in the axial direction different from the position of the receding portion 28*c*1, and the projecting portion 28*c*2 is provided projecting to the surface side of the fixing belt 21 along the thickness direction X of the leading end 28*a* of the separating member as compared with the receding portion 28*c*1. Meanwhile, differently from the embodiments illustrated in FIGS. 10A to 10D, the receding portion 28*c*1 and the projecting portions 28*c*2 are each formed in a flat surface form extending in the axial direction and are connected to each other via level differences 28*d*.

In this manner, by forming the gap forming surface 28*c* of the separating member 28 in a stepped flat surface form and by disposing the projecting portion 28*c*2 on each side of the receding portion 28*c*1 in the axial direction, the shape of the gap forming surface 28*c* can be approximated to the concave curved surface form corresponding to the shape (convex curved surface) of the surface S of the fixing belt 21. Therefore, the variation in separation gap g can be reduced; and in a manner similar to the embodiments illustrated in FIGS. 10A to 10D, the occurrence of jam due to the separation failure, the damage of the fixing belt 21 due to the contact with the separating member 28, the occurrence of abnormal images due to this damage, and the like can be prevented. In the embodiments illustrated in FIGS. 10A to 10D, the width t1 of the separation gap is uniform so that the separation property is excellent while the dimension measurement and dimension management of the gap forming surface 28*c* are difficult; however, this kind of trouble can be solved by the gap forming surface 28*c* with the shapes illustrated in FIGS. 12A to 12D.

In the embodiments illustrated in FIGS. 12A to 12D, both the receding portion 28*c*1 and the projecting portions 28*c*2 are disposed in the region where the paper P passes. In this case, it is enough as long as at least a part (inner part) of the projecting portion 28*c*2 is disposed in the passing region. For example, the level difference 28*d* is disposed displaced by 5 mm inward from each end of the paper P. Even with the above structure, the difference between the minimal width t2 of the separation gap g at the both ends of the paper P and the minimal width t1 of the separation gap g at the center of the paper P in the axial direction can be made small, and the operation effect similar to the above can be obtained. By making the minimal widths t1 and t2 coincide with each other, the separation property can be improved further.

As illustrated in FIGS. 12A to 12D, the projecting portion 28*c*2 can be provided at multiple locations (two in the drawing) on each of one side and the other side of the receding portion 28*c*1 in the axial direction. In this case, the projecting widths of the projecting portion 28*c*2 on the outside and the projecting portion 28*c*2 on the inside from the receding portion 28*c*1 are made different, and the projecting portion 28*c*2 on the outside projects further to the surface S side of the fixing belt 21 as compared with the projecting portion 28*c*2 on the inside. Thus, as compared with the case where the projecting portion 28*c*2 is disposed on each side of the receding portion 28*c*1 in the axial direction, the approximation of the gap forming surface 28*c* of the separating member 28 for the shape of the surface S of the fixing belt 21 can be increased, and the variation in minimal widths t1, t2, and t3 of the separation gap g at the portions 28*c*1 and 28*c*2 can be further suppressed, thereby improving the separation property further. By making all the minimal widths t1, t2, and t3 coincide with each other, the separation property is further increased.

As illustrated in FIGS. 12A to 12D, when the receding portion 28*c*1 and all the projecting portions 28*c*2 are disposed in the region where the paper P' with larger width than the paper P passes, the variation in separation gap g can be prevented for each of paper P and P' with different widths; thus, the stable separation property can be secured for various paper P with different sizes. In this case, it is enough as long as at least a part of the projecting portion 28*c*2 on the outside is located in the region where the paper P' passes.

Figure 12A:
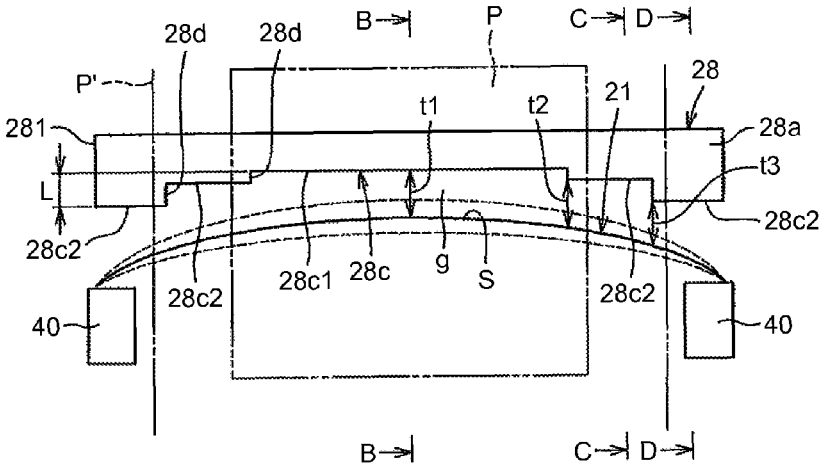
FIGS. 12A to 12D illustrate a separating member according to another embodiment, FIG. 12A corresponds to a front view seen in the direction where a separating unit extends, FIG. 12B corresponds to a sectional view taken along line B-B in FIG. 12A, FIG. 12C corresponds to a sectional view taken along line C-C in FIG. 12A, and FIG. 12D corresponds to a sectional view taken along line D-D in FIG. 12A.
Figure 12B:
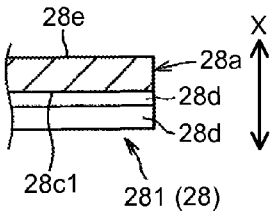
Figure 12C:
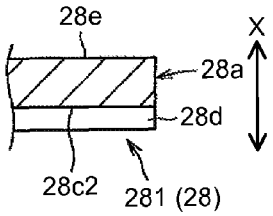
Figure 12D:
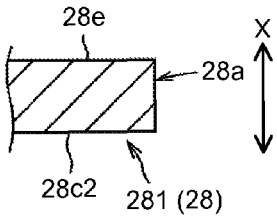
Figure 13:
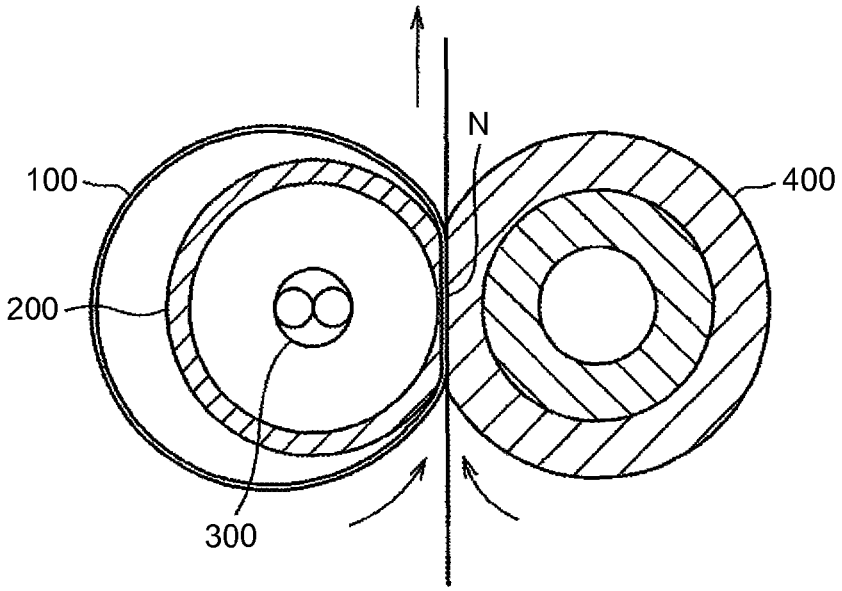
FIG. 13 is a sectional view illustrating a schematic configuration of a conventional fixing device.
Figure 14:
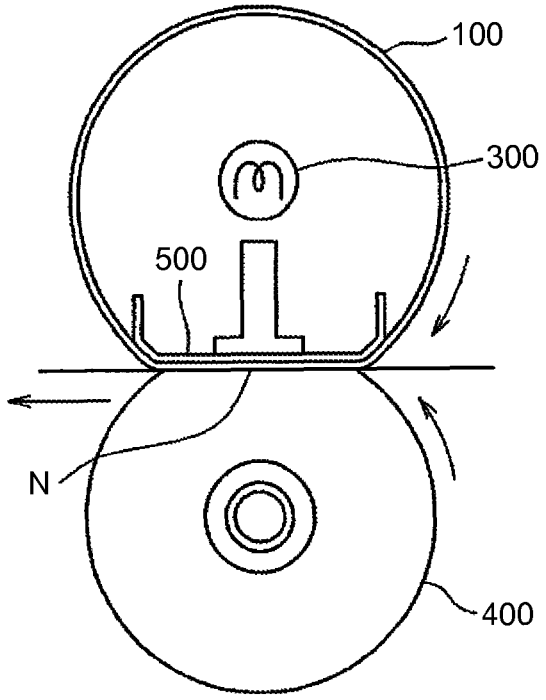
FIG. 14 is a sectional view illustrating a schematic configuration of another conventional fixing device.

By the way, when the rotation speed of the fixing belt 21 is increased or decreased as illustrated by a dashed line in FIG. 12A, the surface shape S of the fixing belt 21 also changes accordingly (the swelling of the fixing belt 21 increase as the rotation speed increases). Accordingly, it is necessary to design the shape of the gap forming surface 28*c* of the separating member 28 or the position of the separating member 28, for example, so that each of the minimal widths t1, t2, and t3 is greater than or equal to the necessary minimal width as the separation gap g even when the rotation speed is the maximal.

In a manner similar to the embodiments illustrated in FIGS. 10A to 10D and FIGS. 12A to 12D, in the fixing device 20 according to the other embodiment of FIG. 9 described above, the leading end 28*a* of the separating member 28 has various thicknesses in the axial direction and is provided with the receding portion 28*c*1 and the projecting portions 28*c*2 with positions in the axial direction different from the position of the receding portion 28*c*1, and the projecting portion 28*c*2 is provided projecting further to the surface side of the fixing belt 21 along the thickness direction X of the leading end 28*a* of the separating member as compared with the receding portion 28*c*1. This can suppress variation in separation gap g in a manner similar to the above embodiments.

The features of the fixing device 20 described above are as follows.

In the fixing device 20, the leading end 28*a* of the separating member 28 has various thicknesses, so that the leading end 28*a* has the receding portion 28*c*1 and the projecting portions 28*c*2 with positions in the axial direction different from the position of the receding portion 28*c*1. The projecting portion 28*c*2 is provided projecting further toward the surface S side of the fixing belt 21 along the thickness direction X of the leading end 28*a* of the separating member as compared with the receding portion 28*c*1. Therefore, by adjusting the positional relation between the receding portion 28*c*1 and the projecting portion 28*c*2 and the individual shape as appropriate, the shape of the leading end 28*a* of the separating member 28 can be set corresponding to the shape of the surface S of the rotating fixing belt 21. Therefore, even when the radial section of the rotating fixing belt 21 is different at plural positions in the axial direction, the variation in separation gap g between the gap forming surface 28*c* of the separating member 28 and the fixing belt 21 can be reduced or the separation gap g can be made uniform. Thus, the occurrence of jam due to the separation failure; the damage of the fixing belt 21 due to the contact with the separating member 28; the occurrence of abnormal images due to this damage; and the like can be prevented.

By providing the projecting portion 28*c*2 at each side of the receding portion 28*c*1 in the axial direction, only each end of the fixing belt 21 is held by the belt holding member 40; therefore, the both ends of the fixing belt 21 become circular (see FIG. 5A) and the part between the both ends becomes elliptical (see FIG. 5B), in which case the variation in separation gap g can also be suppressed for sure.

By disposing the receding portion 28*c*1 and the projecting portions 28*c*2 in the region where the paper P passes, variation in separation gap g can be prevented in at least the region where the paper P passes, thereby improving the separation property.

By forming the receding portion 28*c*1 and the projecting portions 28*c*2 each in a curved surface form in a manner that the both continue smoothly, and by determining the shapes of the receding portion 28*c*1 and the projecting portions 28*c*2 as appropriate, the shape of the gap forming surface 28*c* of the separating member 28 can be approximated to the shape of the surface S of the fixing belt 21 facing those parts.

In this case, by forming the receding portion 28*c*1 and the projecting portions 28*c*2 so that the separation gaps g from the rotating fixing belt surface S facing the parts are equal to each other, the separation property of the separating member 28 is further improved.

By forming the receding portion 28*c*1 and the projecting portions 28*c*2 each in a flat surface form, the dimension measurement and dimension management of the leading end 28*a* of the separating member 28 can be facilitated; and the quality of the separating member 28 at mass production can be stabilized.

In this case, variation in separation gap g can be suppressed practically sufficiently by forming the receding portion 28*c*1 and the projecting portions 28*c*2 so that the minimal widths t1, t2, and t3 of the separation gap from the fixing belt surface S facing those parts during the rotation are equal to each other. Moreover, by providing the plural projecting portions 28*c*2 with different projecting widths to the receding portion 28*c*1 for each of one side and the other side of the receding portion 28*c*1 in the axial direction, the approximation of the gap forming surface 28*c* of the separating member 28 for the surface S of the fixing belt 21 is increased and the separation property is improved, so that the variation in separation gap g to the various P and P' with different paper widths can be suppressed and excellent separation property is obtained.

The embodiments have been described so far, but are not limited to the fixing device in the above embodiments in which the fixing belt is reduced in thickness and diameter for improving the energy saving property and the like. The fixing device can be mounted not just on the color laser printer illustrated in FIG. 1 but also on a monochromatic image forming device, a printer, a copier, a facsimile, a complex machine of these, or the like. In addition, variation modification can be made without departing from the content.

According to the embodiment, a leading end of a separating member is provided with a receding portion and an approaching portion; therefore, the shape of the leading end of the separating member can be changed in accordance with the shape of a facing surface of the fixing belt by adjusting the mutual positional relation between, or the individual shape of the receding portion and the approaching portion as appropriate. As a result, even when the radial cross-sectional shape of the fixing belt during rotation is different at multiple locations in the axial direction, for example, the variation in separation gap between the leading end of the separating member and the fixing belt can be suppressed or the width of the separation gap can be uniformed. This can prevent the occurrence of the jam by stabilizing the separation property of the separating member. Moreover, the damage of the fixing belt due to the contact with the separating member and the occurrence of image abnormality caused thereby can be prevented.

In still another embodiment, provided is a fixing device that includes: an endless fixing belt that is rotatable; a belt holding member holding the fixing belt at each end part in an axial direction thereof; a heat source heating the fixing belt; a nip forming member provided inside the fixing belt; an opposing rotator forming a nip portion between the rotator and the fixing belt by abutting onto the nip forming member via the fixing belt; and a separating member with a leading end thereof provided close to the fixing belt of which both ends in the axial direction are held by the belt holding member, having the thickness of the leading end varying in the axial direction, and configured to separate a recording medium from a surface of the fixing belt.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing belt that is rotatable and endless;

a belt holding member holding the fixing belt at each end part in an axial direction thereof;

a heat source heating the fixing belt;

a nip forming member provided inside the fixing belt;

an opposing rotator forming a nip portion between the opposing rotator and the fixing belt by abutting onto the nip forming member via the fixing belt; and a separating member that extends near the nip portion and separates a recording medium from a surface of the fixing belt, wherein:

a leading end of the separating member is provided with a receding portion; and an approaching portion that is at a different position in the axial direction from a position of the receding portion; and the approaching portion is nearer to the nip portion along an extending direction of the separating member than the receding portion is provided;

wherein the receding portion is more receding closer to a center of the separating member in the axial direction.

2. The fixing device according to claim 1, wherein the approaching portion is disposed on each side of the receding portion in the axial direction.

3. The fixing device according to claim 1, wherein the receding portion and the approaching portions are disposed within a region where the recording medium passes.

4. The fixing device according to claim 1, wherein each of the receding portion and the approaching portions is formed in a curved line form and is formed continuous smoothly.

5. The fixing device according to claim 4, wherein the receding portion and the approaching portions are formed so that separation gaps between the portions and a surface of the fixing belt in rotation that opposes the portions are equal to each other.

6. The fixing device according to claim 1, wherein the receding portion and the approaching portions are formed so that minimal widths of separation gaps between the portions and a surface of the fixing belt in rotation that opposes the portions are equal to each other.

7. The separating member according to claim 6, wherein the receding portion and the projecting portions are formed so that minimal widths of the separation gap between the portions and a surface of the fixing belt while rotating that opposes the portions are equal to each other.

8. The separating member according to claim 6, wherein each of both one side and another side of the receding portion in the axial direction is provided with a plurality of projecting portions that have different projecting widths to the receding portion.

9. The fixing device according to claim 1, wherein each of one side and another side of the receding portion in the axial direction is provided with a plurality of approaching portions that have different amounts of approaching the nip portion.

10. The fixing device according to claim 1, wherein a radial sectional shape of the fixing belt while rotating changes in the axial direction.

11. An image forming device comprising a fixing device, wherein the fixing device comprises:

a fixing belt that is rotatable and endless;

a belt holding member holding the fixing belt at each end part in an axial direction thereof;

a heat source heating the fixing belt;

a nip forming member provided inside the fixing belt;

an opposing rotator forming a nip portion between the opposing rotator and the fixing belt by abutting onto the nip forming member via the fixing belt; and a separating member that extends near the nip portion and separates a recording medium from a surface of the fixing belt, wherein a leading end of the separating member is provided with a receding portion and an approaching portion that is at a different position in the axial direction from a position of the receding portion;

the approaching portion is provided nearer to the nip portion along an extending direction of the separating member than the receding portion is provided; and the receding portion is more receding closer to a center of the separating member in the axial direction.

12. A separating member having a leading end that is configured to be provided close to a rotatable endless fixing belt of which both end parts in an axial direction are held by a belt holding member, and is configured to separate a recording medium from a surface of the fixing belt, wherein the leading end has various thicknesses in the axial direction; and the leading end is thinner closer to a center of the separating member in the axial direction.

13. The separating member according to claim 12, wherein:

the leading end of the separating member is provided with a receding portion and a projecting portion of which position in the axial direction is different from a position of the receding portion; and the projecting portion projects further to a surface side of the fixing belt along a direction of the thickness of the leading end of the separating member than the receding portion projects.

14. The separating member according to claim 13, wherein the projecting portion is disposed on each both sides of the receding portion in the axial direction.

15. The separating member according to claim 13, wherein the receding portion and the projecting portion are provided within a region where the recording medium passes.

16. The separating member according to claim 13, wherein each of the receding portion and the projecting portion is formed in a curved surface form and is formed continuous smoothly.

17. The separating member according to claim 16, wherein the receding portion and the projecting portions are formed so that separation gaps between the portions and a surface of the fixing belt while rotating that opposes the portions are equal to each other.

18. The separating member according to claim 13, wherein each of the receding portion and the projecting portion is formed in a flat surface form.

* * * * *